US010273748B2

(12) United States Patent
Chen

(10) Patent No.: US 10,273,748 B2
(45) Date of Patent: Apr. 30, 2019

(54) BLIND BODY ACTUATOR FOR NON-CORD WINDOW BLIND ASSEMBLY

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 0 days.

(21) Appl. No.: 15/410,477

(22) Filed: Jan. 19, 2017

(65) Prior Publication Data

US 2017/0254144 A1 Sep. 7, 2017

(30) Foreign Application Priority Data

Mar. 3, 2016 (TW) ..... 105106494 A

(51) Int. Cl.

| | |
|---|---|
| ***E06B 9/32*** | (2006.01) |
| ***E06B 9/322*** | (2006.01) |
| ***B65H 57/14*** | (2006.01) |
| ***B65H 75/48*** | (2006.01) |

(52) U.S. Cl.

CPC ..... *E06B 9/322* (2013.01); *B65H 57/14* (2013.01); *B65H 75/486* (2013.01)

(58) Field of Classification Search

CPC . E06B 9/322; E06B 9/323; E06B 9/30; E06B 9/325; E06B 2009/3222; E06B 2009/3225; E06B 2009/2627; B65H 57/14; B65H 75/486; F16H 31/001

See application file for complete search history.

(56) References Cited

U.S. PATENT DOCUMENTS

| | | | | |
|---|---|---|---|---|
| 6,024,154 | A * | 2/2000 | Wang | E06B 9/322 160/168.1 R |
| 6,149,094 | A * | 11/2000 | Martin | E06B 9/322 160/168.1 P |
| 6,289,965 | B1 * | 9/2001 | Ruggles | E06B 9/322 160/170 |
| 6,318,661 | B1 * | 11/2001 | Martin | E06B 9/322 242/373 |
| 6,330,899 | B1 * | 12/2001 | Ciuca | E06B 9/32 160/170 |
| 6,508,293 | B1 * | 1/2003 | Huang | E06B 9/322 160/170 |

(Continued)

FOREIGN PATENT DOCUMENTS

| | | |
|---|---|---|
| TW | M263877 U | 5/2005 |
| TW | M322458 U | 11/2007 |

*Primary Examiner* — Katherine W Mitchell
*Assistant Examiner* — Johnnie A. Shablack
(74) *Attorney, Agent, or Firm* — Muncy, Geissler, Olds & Lowe, P.C.

(57) ABSTRACT

A blind body actuator used in a cordless window blind assembly is provided to include a casing, a winding mechanism, two guide units and two lift cords. The winding mechanism includes two winding wheels and a volute spring connected to the winding wheels. Each of the winding wheels is meshed with one respective lift-cord wheel so that the lift-cord wheels can be driven by the winding mechanism to rotate synchronously. The guide units are respectively disposed adjacent to one respective lift-cord wheel, each including a first cylinder roller. Each of the lift cords is wound around the first cylinder roller of one respective guide unit, having one end thereof connected to one respective lift-cord wheel and an opposite end thereof extended out of the casing.

2 Claims, 5 Drawing Sheets

(56) References Cited

U.S. PATENT DOCUMENTS 6,571,853 B1 * 6/2003 Ciuca ..... E06B 9/322 160/170
6,601,635 B2 * 8/2003 Ciuca ..... E06B 9/32 160/170
6,644,375 B2 * 11/2003 Palmer ..... E06B 9/322 160/170
6,761,203 B1 * 7/2004 Huang ..... E06B 9/322 160/170
6,962,187 B2 * 11/2005 Gilmore ..... E06B 9/322 160/170
7,025,107 B2 * 4/2006 Ciuca ..... E06B 9/303 160/170
7,093,644 B2 * 8/2006 Strand ..... E06B 9/322 160/170
7,228,797 B1 * 6/2007 Hillman ..... E06B 9/322 100/170
7,255,150 B2 * 8/2007 Wu ..... E06B 9/388 160/168.1 R
7,281,563 B2 * 10/2007 Wu ..... E06B 9/32 160/170
7,311,134 B2 * 12/2007 Cheng ..... E06B 9/322 160/170
7,320,354 B2 * 1/2008 Cheng ..... E06B 9/322 160/170
7,406,995 B2 * 8/2008 Huang ..... E06B 9/322 160/170
7,575,036 B2 * 8/2009 Cheng ..... E06B 9/322 160/170
7,717,154 B2 * 5/2010 Cheng ..... E06B 9/322 160/170
8,297,332 B2 * 10/2012 Lin ..... E06B 9/322 160/170
8,662,135 B2 * 3/2014 Lin ..... E06B 9/322 160/168.1 R
8,893,763 B2 * 11/2014 Huang ..... E06B 9/80 160/170
8,925,615 B2 * 1/2015 Lin ..... E06B 9/322 160/170
8,936,062 B2 * 1/2015 Huang ..... E06B 9/322 160/170
9,127,500 B2 * 9/2015 Huang ..... E06B 9/322
9,260,912 B2 * 2/2016 Huang ..... E06B 9/322
9,272,875 B2 * 3/2016 Lin ..... B65H 57/00
9,297,203 B2 * 3/2016 Hsueh-Cheng ..... E06B 9/326
9,366,077 B2 * 6/2016 Chen ..... F16H 31/001
9,435,153 B2 * 9/2016 Chen ..... E06B 9/322
9,435,154 B2 * 9/2016 Chen ..... E06B 9/34
9,482,049 B2 * 11/2016 Chen ..... E06B 9/322
9,574,396 B2 * 2/2017 Toti ..... E06B 9/322
9,587,428 B2 * 3/2017 Huang ..... E06B 9/322
9,714,538 B2 * 7/2017 Huang ..... E06B 9/322
9,797,189 B2 * 10/2017 Huang ..... E06B 9/30
9,845,639 B2 * 12/2017 Chen ..... E06B 9/322
9,874,057 B2 * 1/2018 Huang ..... E06B 9/322
2004/0177933 A1 * 9/2004 Hillman ..... E06B 9/322 160/170
2006/0096719 A1 * 5/2006 Wu ..... E06B 9/32 160/170
2006/0278348 A1 * 12/2006 Huang ..... E06B 9/322 160/170
2007/0227677 A1 * 10/2007 Yu ..... E06B 9/322 160/170
2007/0272364 A1 * 11/2007 Liang ..... E06B 9/322 160/84.05
2008/0000592 A1 * 1/2008 Huang ..... E06B 9/322 160/170
2008/0185109 A1 * 8/2008 Lin ..... E06B 9/262 160/170
2009/0159219 A1 * 6/2009 Wen ..... E06B 9/322 160/170
2009/0205793 A1 * 8/2009 Cheng ..... E06B 9/322 160/405
2009/0283223 A1 * 11/2009 Liu ..... E06B 9/322 160/84.02
2010/0206492 A1 * 8/2010 Shevick ..... E06B 9/30 160/170
2011/0061823 A1 * 3/2011 Lin ..... E06B 9/262 160/340
2013/0032300 A1 * 2/2013 Yu ..... E06B 9/322 160/84.02
2014/0083631 A1 * 3/2014 Huang ..... E06B 9/322 160/170
2014/0224431 A1 * 8/2014 Lin ..... A47H 5/032 160/84.01
2014/0262063 A1 * 9/2014 Huang ..... E06B 9/322 160/84.02
2014/0291431 A1 * 10/2014 Huang ..... E06B 9/322 242/372
2015/0129142 A1 * 5/2015 Huang ..... E06B 9/262 160/370
2015/0136336 A1 * 5/2015 Huang ..... E06B 9/322 160/170
2015/0176329 A1 * 6/2015 Chen ..... E06B 9/322 160/176.1 R
2015/0275572 A1 * 10/2015 Huang ..... E06B 9/322 160/173 R
2015/0275573 A1 * 10/2015 Huang ..... E06B 9/322 160/192
2015/0354270 A1 * 12/2015 Huang ..... E06B 9/322 160/170
2016/0123073 A1 * 5/2016 Chen ..... E06B 9/34 160/170
2016/0123447 A1 * 5/2016 Chen ..... F16H 31/001 160/168.1 P
2016/0230453 A1 * 8/2016 Chen ..... E06B 9/322
2016/0230454 A1 * 8/2016 Chen ..... E06B 9/322
2016/0265272 A1 * 9/2016 Chen ..... E06B 9/322
2016/0298385 A1 * 10/2016 Chen ..... E06B 9/322
2016/0312528 A1 * 10/2016 Huang ..... E06B 9/322
2017/0022755 A1 * 1/2017 Huang ..... E06B 9/322
2017/0107075 A1 * 4/2017 Hung ..... B65H 75/4405
2017/0145743 A1 * 5/2017 Lei ..... B65H 75/26
2017/0204656 A1 * 7/2017 Chen ..... E06B 9/322
2017/0211318 A1 * 7/2017 Chen ..... E06B 9/322
2017/0211319 A1 * 7/2017 Wei ..... E06B 9/322
2017/0211321 A1 * 7/2017 Chen ..... E06B 9/322
2017/0254144 A1 * 9/2017 Chen ..... E06B 9/322
2017/0275943 A1 * 9/2017 Huang ..... B65H 75/486
2017/0292321 A1 * 10/2017 Chen ..... B65H 75/4434
2017/0292322 A1 * 10/2017 Chen ..... B65H 75/4434
2017/0298688 A1 * 10/2017 Chen ..... E06B 9/262
2017/0321476 A1 * 11/2017 Zhang ..... E06B 9/303
2017/0321477 A1 * 11/2017 Chen ..... E06B 9/322

* cited by examiner

BLIND BODY ACTUATOR FOR NON-CORD WINDOW BLIND ASSEMBLY

BACKGROUND OF THE INVENTION

1. Field of the Invention

The present invention relates to window blind technology and more particularly, to a blind body actuator for a non-cord window blind assembly.

2. Description of the Related Art

Commercial window blinds can be classified into corded window blinds and cordless window blinds. The corded window blind uses a pull cord for pulling by a user to adjust the slats between an extended status and a received status, while the cordless window blind uses manual power to upward push or downward pull the bottom rail, so that the blind body can be extended out or received.

It is known that Taiwan patent No. 263877 and patent No. 322458 describe improved actuator designs for lifting the blind body of a window blind. However, the abovementioned designs cannot only effectively reduce the structural complexity, but also unable to provide the blind body with optimal transmission effects.

SUMMARY OF THE INVENTION

The present invention has been accomplished under the circumstances in view. It is an objective of the present to provide a blind body actuator for cordless window blind assembly, which has a simple structure and provides optimal transmission effects.

To achieve this and other objectives of the present invention, a blind body actuator for cordless window blind assembly comprises a casing, a winding mechanism, two lift-cord wheels, two guide units and two lift cords. The winding mechanism comprises two winding wheels and a volute spring. The two winding wheels are rotatably mounted in the casing and meshed with each other. The volute spring is connected to the winding wheels and alternatively wound around one of the two winding wheels. The lift-cord wheels are rotatably mounted in the casing and respectively meshed with one respective winding wheel, thus, the lift-cord wheels can be driven by the winding mechanism to rotate synchronously. The guide units are mounted inside the casing and respectively disposed adjacent to one of the lift-cord wheels. Each of the guide units comprises a first cylinder roller rotatably mounted in the casing. Each of the first cylinder rollers, the winding wheels, and the lift-cord wheels has an axle respectively, and the axles of the first cylinder rollers, the winding wheels, and the lift-cord wheels are parallel to each other. The lift cords are respectively wound around the first cylinder rollers of the guide units. Each of the lift cords has one end thereof connected to one respective lift-cord wheel so that each lift cord is capable of being wound or unwound around the respective lift-cord wheel by the rotation of the respective lift-cord wheels. Further, each of the lift cords has an opposite end thereof extended out of the casing for connection to a bottom rail.

Thus, when extending out the blind body of the cordless window blind assembly, the lift cords are driven by the bottom rail of the blind body to rotate the respective lift-cord wheels, causing rotation of the meshed winding wheels, and thus, the volute spring starts to accumulate and store elastic force upon rotation of the two winding wheels. After the blind body is fully extended out, release the pulling force to the bottom rail. When receiving the blind body, by means of the pushing force excreted to the bottom rail and the restoring elastic force from the lift cords, the winding wheels will drive the meshed lift-cord wheels to rotate synchronously, enabling the respective lift cords to be gradually wound around by the respective lift-cord wheels. Once the blind body is fully received, then release the pushing force toward the bottom rail. Either in the process of extending out the blind body or receiving the blind body, the lift cords can be moved steadily and smoothly by the rotation of the cylinder rollers of the guide units, and thus, the overall operation process can achieve optimal actuation effects.

Other advantages and features of the present invention will be fully understood by reference to the following specification in conjunction with the accompanying drawings, in which like reference signs denote like components of structure.

DETAILED DESCRIPTION OF THE INVENTION

Figure 1:
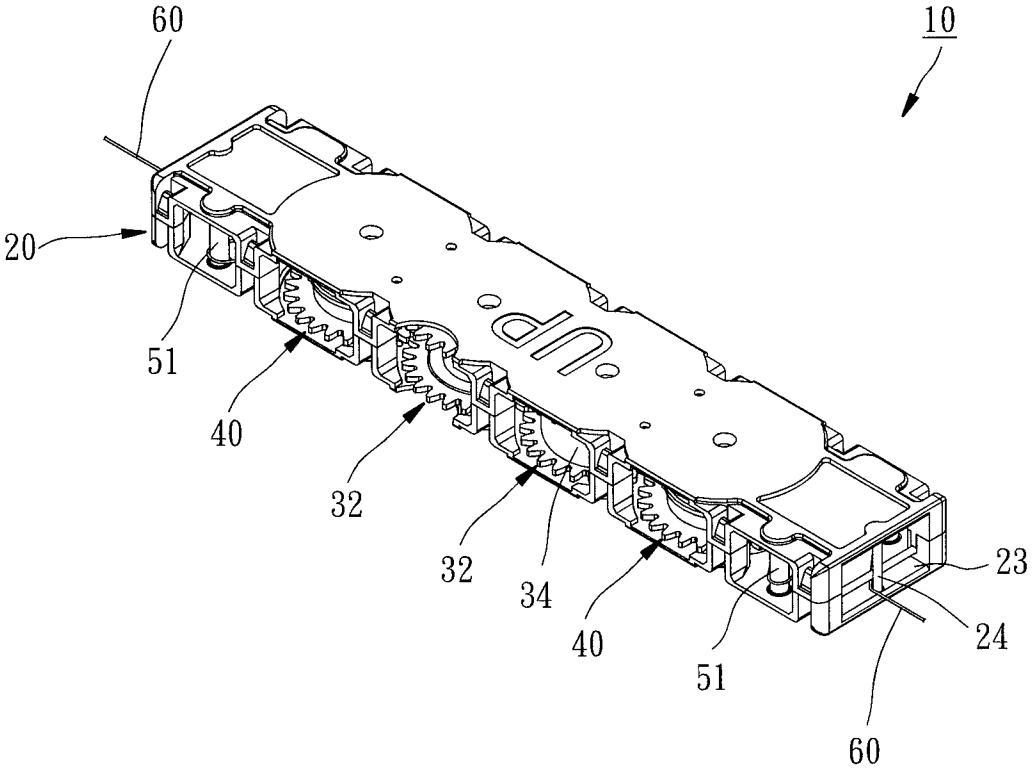
FIG. 1 is an oblique top elevational view of a blind body actuator in accordance with the present invention.
Figure 2:
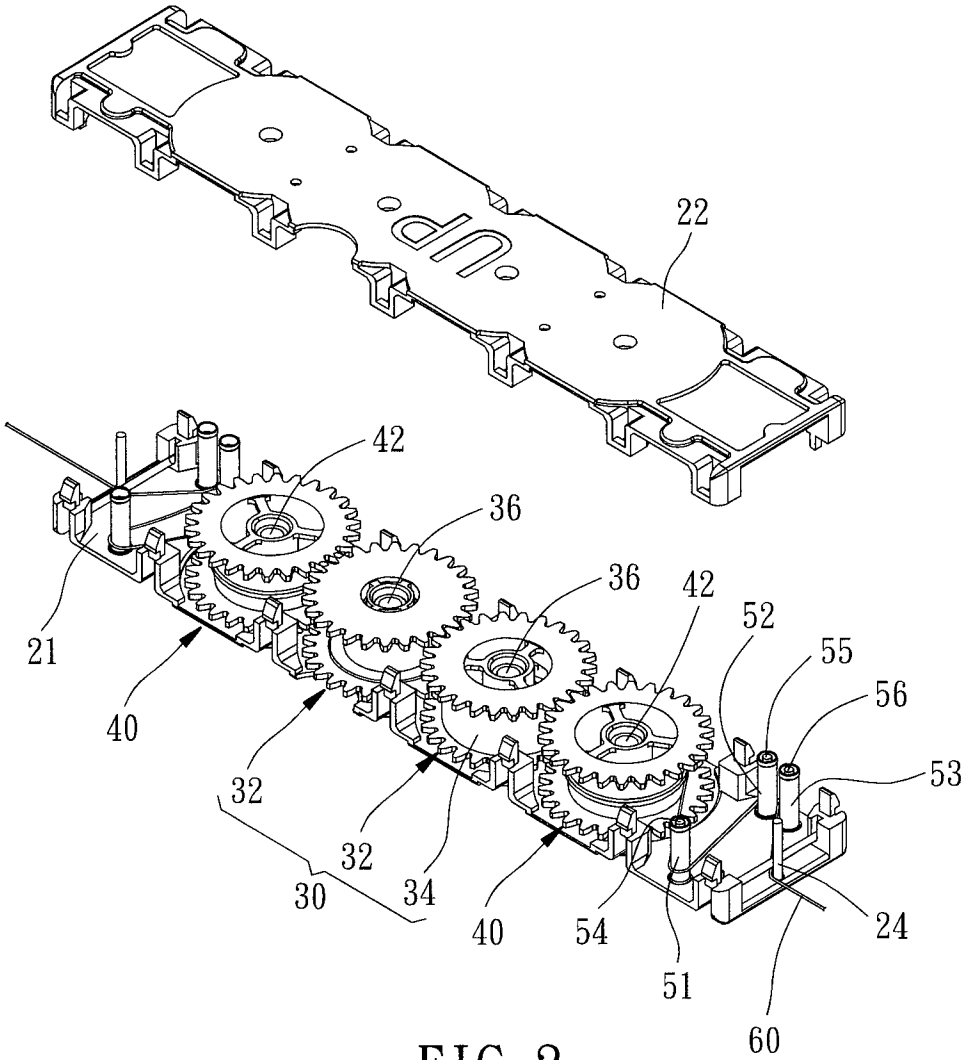
FIG. 2 is an exploded view of the blind body actuator in accordance with the present invention.

Referring to FIGS. 1 and 2, a blind body actuator 10 in accordance with the present invention is shown. The blind body actuator 10 comprises a casing 20, a winding mechanism 30, two lift-cord wheels 40, two guide units 50, and two lift cords 60.

The casing 20 is mounted inside a headrail 12 and the casing 20 comprises a bottom panel 21, a top panel 22 covering the bottom panel 21, an opening 23 defined between the bottom panel 21 and the top panel 22 in each of two lateral sides thereof and a cross bar 24 located in each opening 23 and fixedly connected between the bottom panel 21 and the top panel 22 in such a manner that a center of the cross bar 24 coincides with a center of the respective opening 23.

The winding mechanism 30 comprises two winding wheels 32, and a volute spring 34. The two winding wheels 32 are rotatably mounted inside the casing 20 by a respective first wheel axle 36 and meshed with each other. The volute spring 34 has two opposite ends thereof respectively connected to the two winding wheels 32. Subject to relative rotation between the two winding wheels 32, the volute spring 34 is wound around one of the winding wheels 32.

The lift-cord wheels 40 are rotatably mounted inside the casing 20 by a respective second wheel axle 42 and respectively meshed with one respective winding wheel 32 so that each of the lift-cord wheels 40 is rotatable with the meshed winding wheel 32 synchronously.

The guide units 50 are mounted inside the casing 20 and respectively disposed adjacent to the lift-cord wheels 40.

Each of the guide units 50 comprises a first cylinder roller 51, a second cylinder roller 52 and a third cylinder roller 53. The first cylinder roller 51 is rotatably mounted in the casing 20 and adjacent to one peripheral side, namely, a front side of the casing 20 by a first roller axle 54. The second cylinder roller 52 is rotatably mounted in the casing 20 and adjacent to an opposing peripheral side, namely, a rear side of the casing 20 by a second roller axle 55. The third cylinder roller 53 is rotatably mounted in the casing 20 and adjacent to the rear side of the casing 20 by a third roller axle 56 and kept spacedly arranged to the second cylinder roller 52. Further, the axles 36,42,54,55,56 are parallel to each other. The first cylinder roller 51, the second cylinder roller 52 and the third cylinder roller 53 are made of plastic material.

Figure 3:
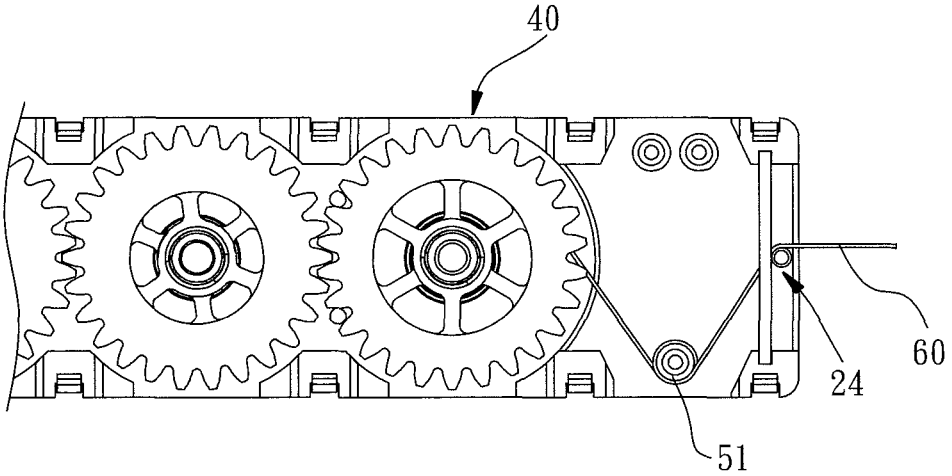
FIG. 3 is a schematic partial top view of the present invention, illustrating the lift cord wound around the first and second cylinder rollers.
Figure 4:
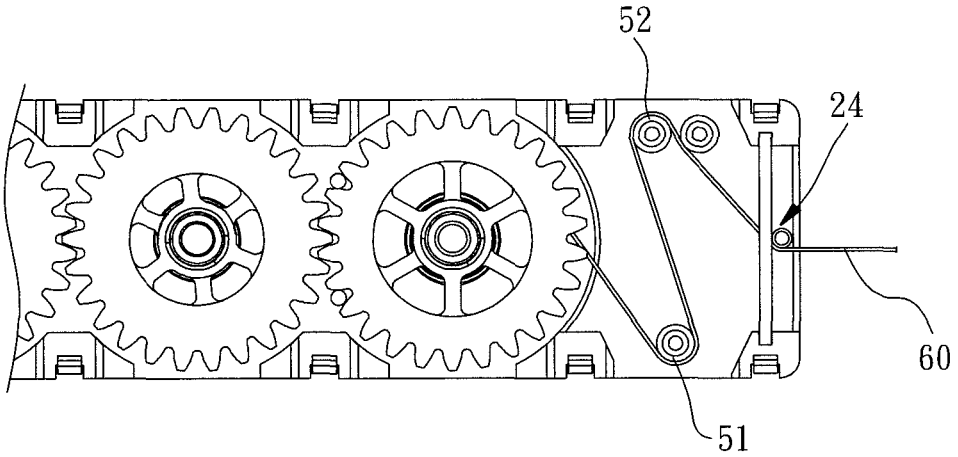
FIG. 4 is similar to FIG. 3, illustrating the lift cord wound around the first cylinder roller.
Figure 5:
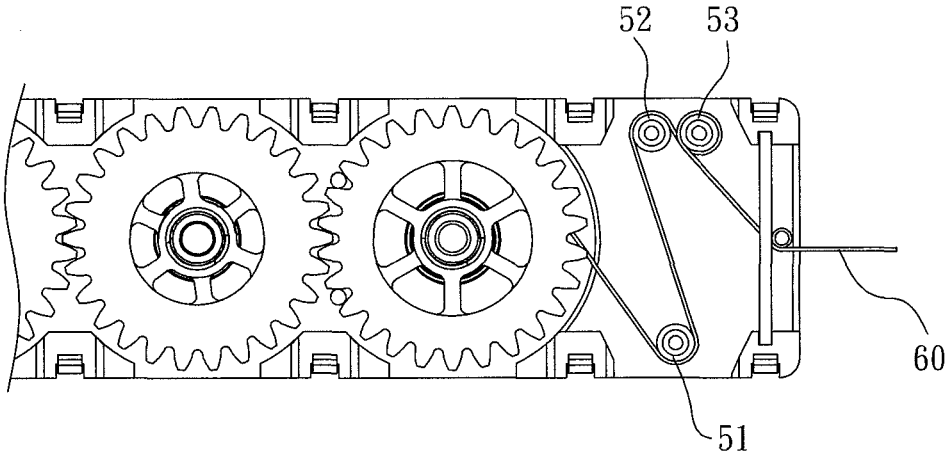
FIG. 5 is similar to FIG. 3, illustrating the lift cord wound around the first, second and third cylinder rollers.
Figure 6:
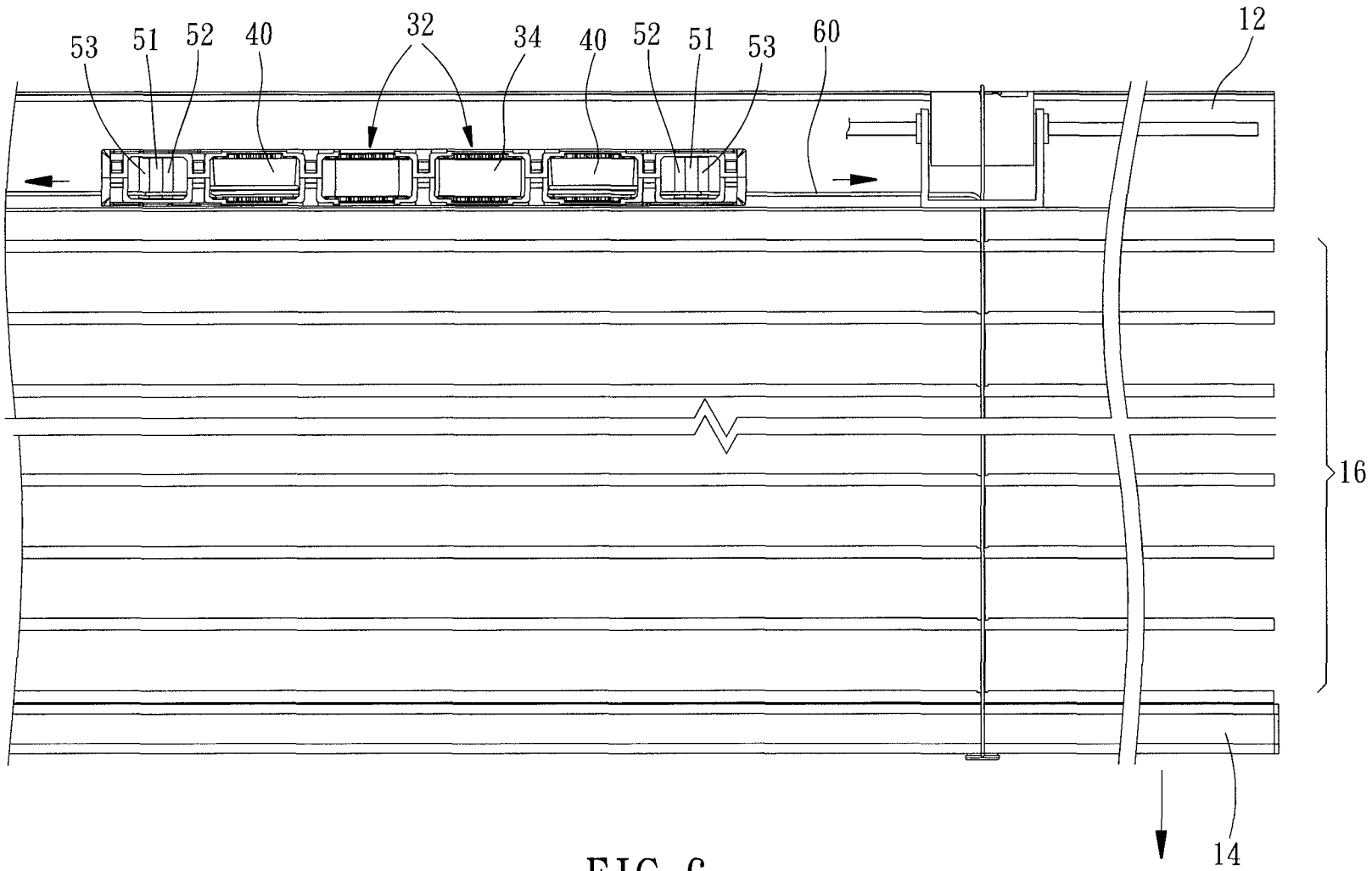
FIG. 6 is a schematic applied view of the present invention, illustrating that the slats are in an extended status.
Figure 7:
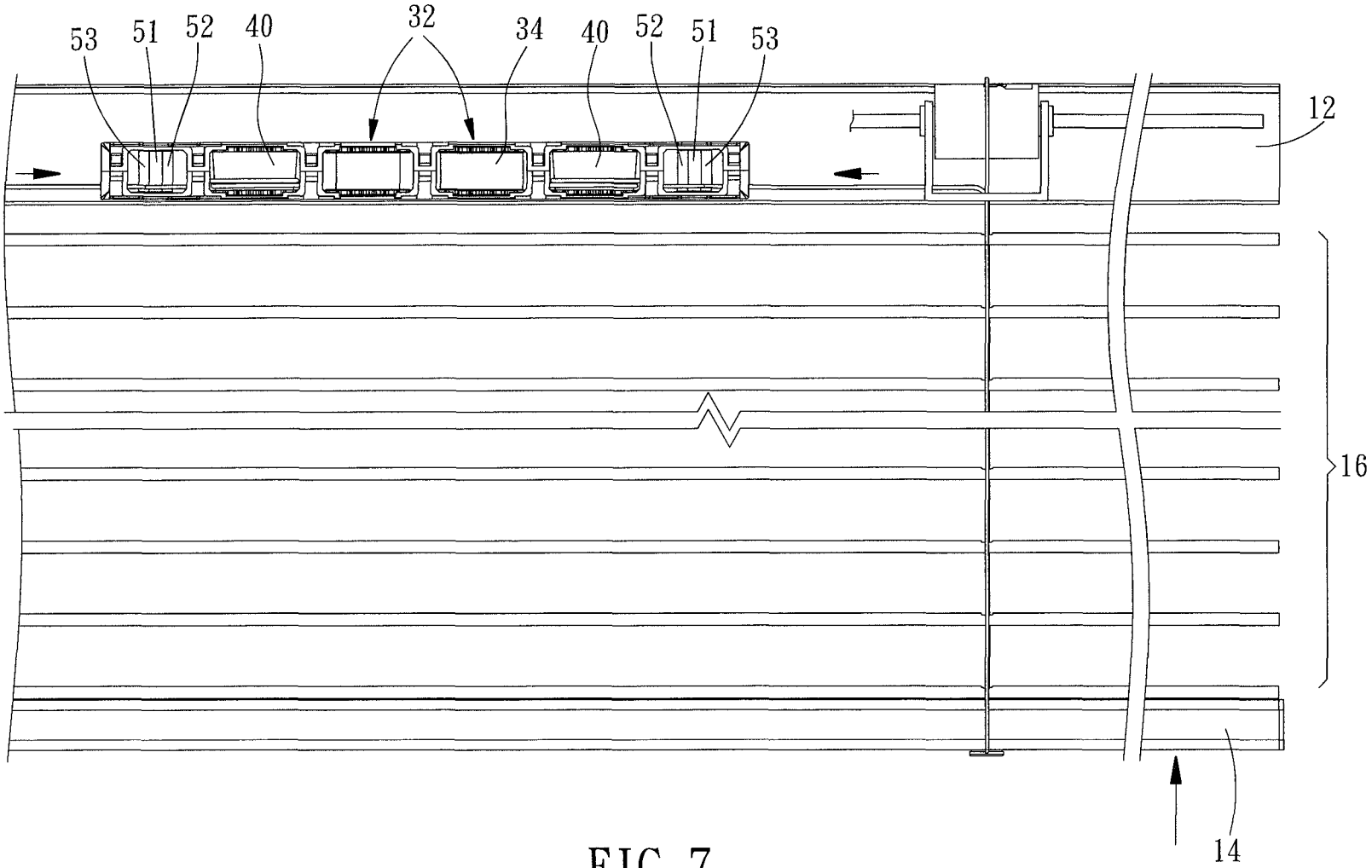
FIG. 7 is similar to FIG. 6, illustrating that the slats are in a received status.

The two lift cords 60 have respective one ends thereof respectively fixedly connected to the respective lift-cord wheels 40 so that the two lift cords 60 can be wound by the respective lift-cord wheels 40 or unwound around the respective lift-cord wheels 40 by the rotation of the respective lift-cord wheels 40. Further, the two lift cords 60 can be selectively extended through the respective guide units 50 by different winding methods according to the size of the window blind. In the application example shown in FIG. 3, each lift cord 60 is wound around the first cylinder roller 51 of the associating guide unit 50 through one turn and then extended out of the casing 20 through the adjacent opening 23, and then connected to a bottom rail 14. In the application example shown in FIG. 5, the blind body actuator 10 is used in a large size window blind where each lift cord 60 is wound around the first cylinder roller 51 of the associating guide unit 50 through a half turn, and then wound around the second cylinder roller 52 of the associating guide unit 50 through a half turn, and then wound around the third cylinder roller 53 of the associating guide unit 50 through one turn, and then extended out of the casing 20 through the adjacent opening 23 for connection to the bottom rail of the window blind. In any of the aforesaid various winding methods, the lift cords 60 will be abutted against the center of the respective cross bars 24 of the casing 20 when extended out of the respective openings 23, enhancing actuation stability.

When extending out the blind body 16 that is connected between the headrail 12 and the bottom rail 14, pull the bottom rail 14 downward to gradually extend out the lift cords 60. The lift-cord wheels 40 are accordingly rotated and cause the rotation of the meshed winding wheels 32. At this time, the volute spring 34 is unwound from one winding wheel 32 relative to the other winding wheel 32 to store elastic force. After the blind body 16 is fully extended out, release the pulling force to the bottom rail 14. At this time, the gravity weight of the bottom rail 14 and the stored elastic force of the volute spring 34 are maintained in static balance, and thus, the blind body 16 is held in the extended status.

When receiving the blind body 16, push the bottom rail 14 upward to loosen the lift cords 60. At this time, the elastic force of the volute spring 34 works with the user's manual power to cause the winding wheels 32 to rotate reversely and synchronously. During the reverse rotation of the winding wheels 32, the lift-cord wheels 40 are rotated by the respective winding wheels 32 to wind around the respective lift cords 60. Once the blind body 16 is fully received, the user releases the pushing force to the bottom rail 14. At this time, the gravity weight of the bottom rail 14 and the elastic force of the volute spring 34 are maintained in static balance again, and thus, the blind body 16 is held in the received status.

Either in the process of extending out the blind body 16 or receiving the blind body 16, the first, second and/or third cylinder rollers 51,52,53 of the guide units 50 can be driven to rotate by the respective lift cords 60 by means of the friction force generated therebetween, enhancing the stability and smoothness of the movement of the lift cords 60, and thus, the overall operation process can achieve optimal actuation effects.

What is claimed is:

1. A blind body actuator for cordless window blind, comprising:

a casing;

a winding mechanism comprising two winding wheels and a volute spring, said two winding wheels being rotatably mounted in said casing and meshed with each other, said volute spring being connected to said two winding wheels and capable of being wound around one of said winding wheels;

two lift-cord wheels being rotatably mounted in said casing and each of said two lift-cord wheels being meshed with a corresponding one of said two winding wheel;

two guide units being mounted in said casing and respectively disposed adjacent to said lift-cord wheels, each of said guide units comprising a first cylinder roller rotatably mounted in said casing, each of said first cylinder rollers, said winding wheels, and said lift-cord wheels having an axle respectively, and said axles of said first cylinder rollers, said winding wheels, and said lift-cord wheels being parallel to each other; and two lift cords respectively wound around said first cylinder rollers of said guide units respectively, each of said lift cords having one end thereof connected to one respective said lift-cord wheel so that each said lift cord is capable of being wound around or unwound around the respective said lift-cord wheel by the rotation of the respective said lift-cord wheels, each of said lift cords having an opposite end thereof extended out of said casing;

wherein each of said guide units further comprises a second cylinder roller and a third cylinder roller respectively and rotatably mounted in said casing adjacent to one peripheral side of said casing in a parallel manner; said first cylinder roller is disposed adjacent to an opposing peripheral side of said casing; each of said lift cords is wound around said first cylinder roller of the respective said guide unit through a half turn, and then wound around said second cylinder roller of the respective said guide unit through a half turn, and then wound around said third cylinder roller of the respective said guide unit through one turn.

2. The blind body actuator as claimed in claim 1, wherein said casing comprises two opposite sides, an opening defined in each of said two opposite sides, and a cross bar disposed in each of said openings in such a manner that a center of each said cross bar coincides with a center of the corresponding said opening; each of said lift cords is extended out of said casing through one respective said opening and peripherally abutted against said center of said corresponding cross bar.

* * * * *